United States Patent [19]

Kerbs, Jr.

[11] 3,954,239

[45] May 4, 1976

[54] CARRIER FOR GOLF EQUIPMENT OR SIMILAR ITEMS

[76] Inventor: Charles F. Kerbs, Jr., 1836A Wildberry Drive, Glenview, Ill. 60025

[22] Filed: Jan. 7, 1974

[21] Appl. No.: 431,329

[52] U.S. Cl. ..... 248/96; 211/60 G; 150/1.5 B

[51] Int. Cl.[2] ..... A63B 55/00

[58] Field of Search ..... 224/29.2, 5.5, 45 R, 224/45.11; 211/60 G; 150/1.5 S, 1.5 G, 1.5 B; 248/96

[56] References Cited

UNITED STATES PATENTS

| | | | |
|---|---|---|---|
| 699,391 | 5/1902 | Johnson | 211/60 G |
| 1,627,459 | 5/1927 | Ranney | 248/96 |
| 2,024,484 | 12/1935 | Smith | 150/1.5 B |
| 2,064,433 | 12/1936 | Kronthal | 150/1.5 B |
| 2,091,298 | 8/1937 | Agnew | 211/60 G |
| 2,570,504 | 10/1951 | Van House | 224/29 B |
| 2,572,408 | 10/1951 | Hoek | 248/96 |
| 2,751,176 | 6/1956 | Mowry | 248/96 |
| 2,881,925 | 4/1959 | Idoux | 211/60 G |
| 3,172,585 | 3/1965 | Mahaney et al. | 224/45 R |
| D222,720 | 12/1971 | Lapham et al. | 224/45 R |

FOREIGN PATENTS OR APPLICATIONS

| | | | |
|---|---|---|---|
| 421,090 | 12/1934 | United Kingdom | 150/1.5 B |

*Primary Examiner*—Robert J. Spar
*Assistant Examiner*—Kenneth Noland
*Attorney, Agent, or Firm*—Richard J. Myers

[57] ABSTRACT

A carrier adapted for transporting items such as golf clubs and including a plurality of spaced tiers with a bottom support tier and intermediate and upper tiers having openings adapted to receive transported articles. A ball carrier is also provided for easily inserting and removing golf balls or similar items. The carrier also includes an elongated central framing member with the top portion adapted to provide a carrying handle and a bottom pointed portion for insertion into the ground.

1 Claim, 6 Drawing Figures

CARRIER FOR GOLF EQUIPMENT OR SIMILAR ITEMS

BACKGROUND OF THE INVENTION

1. Field of the Invention

This invention pertains to portable article transporting devices and in particular transporting devices directed to carrying sports equipment such as golf clubs and golf balls.

2. Description of the Prior Art

Prior art transporting devices such as those adapted to carry a smaller than usual number of golf clubs have merely provided devices which are essentially miniaturized golf bags. These portable devices generally have been unable to assume a free standing position and must be laid on the ground whenever the golf clubs are used and when the bag is stored. The present invention provides a portable transporting device having a pointed stake portion which provides for free standing of the carrier, for instance on a fairway. Additionally, the device includes horizontally extending stabilizing legs which permit the carrier to be positioned in a leaning manner against a building, tree or other similar support. This article carrying device is adapted for example, to carry a fewer number of golf clubs then are generally carried on an eighteen hole golf course and is therefore more particularly suited for use on shorter par three courses.

SUMMARY OF THE INVENTION

This invention is directed to an article carrying device which may be easily carried by a person and includes a spike for supporting the carrier on soft earth or other suitable mounting surfaces. Additionally, the portable carrier includes a plurality of vertically spaced platforms or racks which contain aligned openings for storage of articles such as golf clubs or other sporting equipment or similarly designed long thin articles. The preferred embodiment of the invention provides three vertically spaced racks including a solid bottom or supporting rack and two upper apertured racks for storage of golf clubs. Additionally, a ball carrier is provided extending between the intermediate and upper rack and defined by three spaced rods which extend between apertured top and bottom plates thereby defining a skeletonized ball carrier which allows balls to be easily inserted into and removed from the carrier.

This portable article transporting device also includes horizontally extending stabilizing legs which protrude from both the upper and the lower racks thereby permitting the carrier to be stored in a generally upright position leaning onto a wall, tree or other similar supporting member. The stabilizing legs also allow the carrier to be disposed at a convenient angle for easily removing articles such as golf clubs. By providing these horizontally extending legs, the user is not required to lay the carrier on the ground when it is being stored or when an article being transported, such as a golf club, is being used.

In an alternate form of the invention, the upper and intermediate racks may be formed from bent wires thereby providing a plurality of outwardly extending fingers which can rigidly support golf clubs or other similar articles which may be snapped into the space between the fingers.

It is an object of the present invention to provide a lightweight, rigid, and highly portable article transporting device such as a device suited for transport of golf clubs or other similar articles.

Another object of the present invention is to provide an article transporting device which includes an elongated central support member having a pointed end for insertion into the ground and also having a handle portion and including a plurality of spaced tiers intermediate the handle and pointed end portions with means for attachment and restraint of articles such as golf clubs which are being carried.

Yet another object of the present invention is to provide an article transporting device for transporting golf clubs and including three spaced tiers formed from wire with two upper tiers having fingers for receiving of golf club members.

Another object is to provide an article transporting device which includes a ball storage member which is a skeletonized ball storage compartment formed with a plurality of vertically extending rods and including a top plate having an opening for insertion and removal of golf balls.

These and other objects of the invention will become apparent from reference to the following specification and claims.

DESCRIPTION OF THE PREFERRED EMBODIMENT

Figure 1:
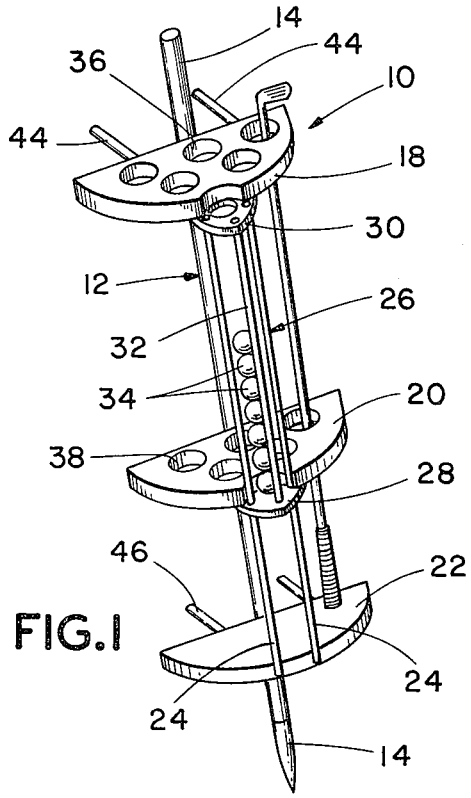
FIG. 1 is a pictorial view of the article transporting device.
Figure 3:
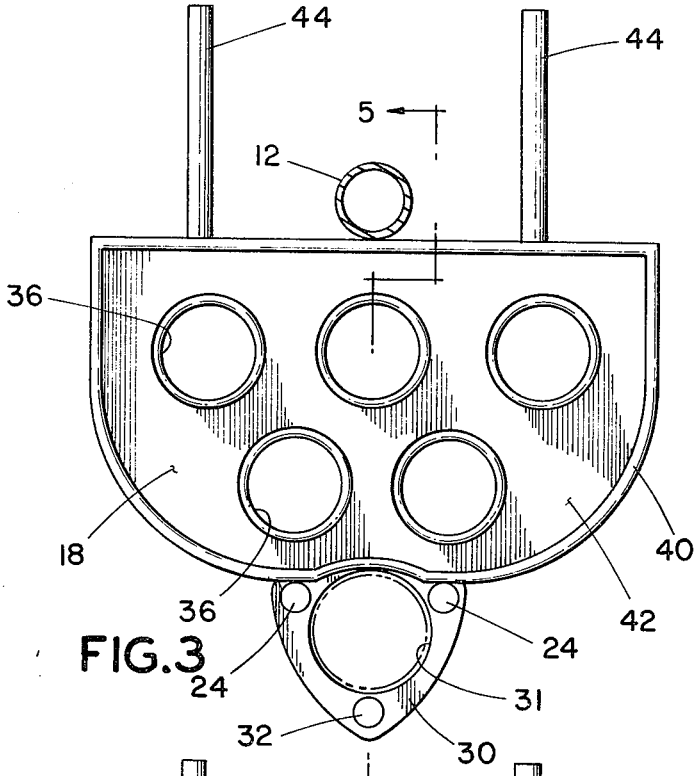
FIG. 3 is a sectional view taken generally along lines 3—3 of FIG. 2.
Figure 4:
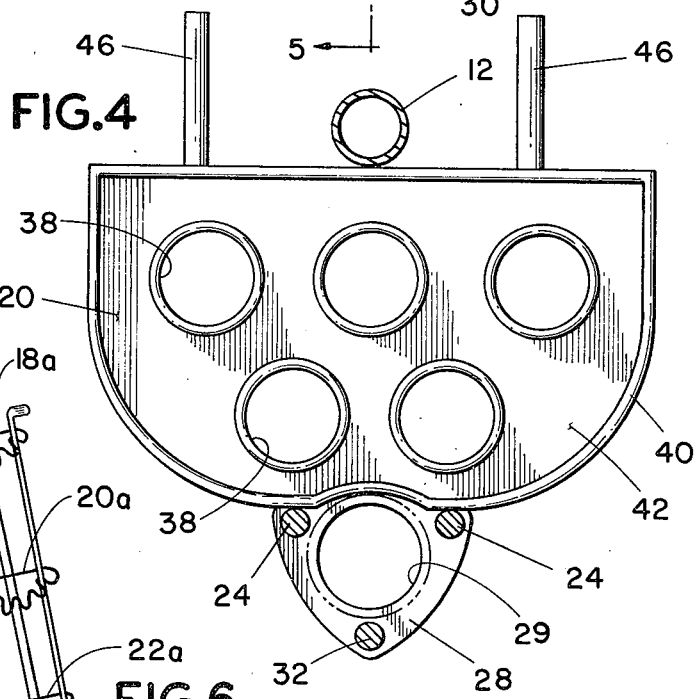
FIG. 4 is a sectional view taken generally along lines 4—4 of FIG. 2.
Figure 2:
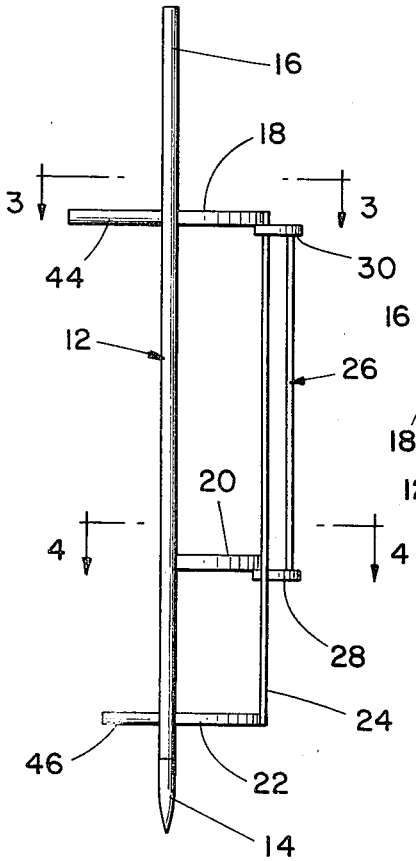
FIG. 2 is a side elevational view of the device illustrated in FIG. 1.

With reference to the drawings and in particular to FIG. 1 there is illustrated in pictorial fashion the article carrier 10 of the present invention. The carrier 10 includes an elongated upright 12 which includes a lower pointed end 14 and a vertically spaced handle portion 16. The pointed end 14 may be an integral part of the upright 12 or a separate tip attached for ease of replacement. Upright 12 provides a mounting surface for attachment of the upper tier 18, the intermediate tier 20 and the lower tier 22. Framing rods 24 extend in a parallel manner from the lower tier or support 22.

A ball carrier 26 is provided by adding a bottom plate 28 to the intermediate rack 20 and a top plate 30 to the upper rack or tier 18. Bottom plate 28 includes an opening 29 which is smaller than the diameter of a golf ball and thereby will form a seat for receiving a golf ball. Likewise, the top plate 30 also includes an opening 31. The opening 31 in the top is slightly larger than a golf ball thereby permitting a golf ball to be easily inserted into the ball carrier 26. Golf balls as stored in the carrier 26 are indicated by the numeral 34. Thus, it is noticed that the framing rods 24 combine with the ball carrier reinforcing rod 32 to provide a skeletonized ball carrier which will easily store a number of balls and yet provides a lightweight structure which will not make the carrier unusually heavy and objectionable for portable transport. As disclosed in the drawings, the framing rods 24 extend through the bottom 28 and the top 30 of the ball carrier and thereby are indirectly connected to the upper tier 18 and the intermediate tier 20 therefore adding to the rigidity of the entire carrier 10. However, should manufacturing procedures indicate, the reinforcing rods 24 could easily be attached in a manner so as to directly interconnect the upper, intermediate and lower tiers 18, 20, 22 respectively. Additionally, the top plate 30 and the lower plate 28 of the ball carrier may be fastened to the associated tier by use of an adhesive or by mechanical fasteners such as self threading screws.

The top rack 18 includes a plurality of openings 36 which are in vertical alignment with associated openings 38 which are disposed in the intermediate tier or rack 20. As mentioned earlier, the lower rack 22 is a solid member adapted to provide vertical support to articles such as golf clubs which are being carried.

Figure 5:
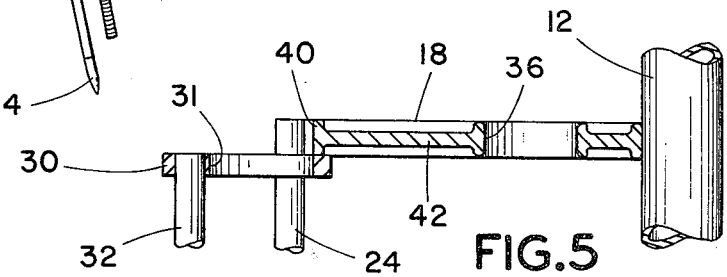
FIG. 5 is a sectional view taken generally along lines 5—5 of FIG. 3; and, FIG. 6 is a pictorial view of an alternate form of the invention.

With reference to FIG. 5, it is noticed that the top tier 18 may include an irregular cross section which is provided in case the top is injection molded from a rigid plastic or from a lightweight metal. The top rack is illustrated in FIG. 5 and the identical construction is contemplated for the intermediate rack 20. The rack 18 as illustrated in FIG. 5, includes the opening 36. Surrounding the periphery of the rack 18 is a rim portion 40 which is substantially thicker than the connecting web section 42. Thus, such a construction provides a rigid member which is lightweight and has inherent economies which are provided through efficient use of materials.

The racks or tiers 18, 20 and 22, may all be attached to the upright 12 by any suitable fastening means such as adhesive or mechanical fastener or in fact, the tiers may be provided with a connecting portion which encircles or attaches to the upright 12.

Additionally, it is contemplated that the upper rack 18 as well as the bottom support rack 22 will include a pair of horizontally extending stabilizing legs designated by numeral 44 on the upper tier and 46 on the lower or support tier 22. Thus the carrier 10 may be stored in an upright position with the three point support provided by the pointed end portion 14 of upright 12 in combination with either the two lower stabilizing legs 46 or the two upper stabilizing legs 44 which may be in contact with a vertically extending support member such as the side of a building or a tree. These stabilizing legs eliminate the requirement of placing the carrier 10 on the ground when an article such as a golf club, has been removed for use. Upright storage eliminates prior problems of contaminating the contents of the carrier with moisture, dirt, or other elements.

Figure 6:
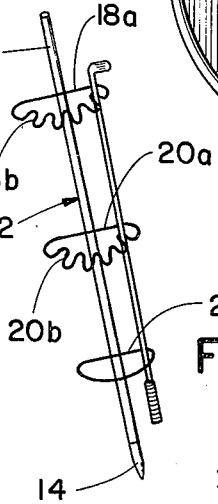

The modification or alternate embodiment illustrated in FIG. 6 uses members which are analogous to members used in the preferred embodiment and are therefore designated by members common to members which have been referred to in the earlier explanation and followed by alphabetical suffixes. Thus, in the modification there is also provided an upright 12 having a pointed end portion 14 and a spaced handle portion 16. A plurality of tiers are provided and include a top tier **18*a*, an intermediate tier 20*a* and a lower tier 22*a*. The upper tier includes a plurality of integrally formed finger portions 18*b*. Similarly the intermediate tier includes a plurality of integrally formed finger portions designated 20*b*. The three tiers in this modified version are all wire forms which are attached to the upright 12 and extend in an enclosed fashion to provide an attaching or restraining point for articles, such as golf clubs, which are being transported. It is contemplated that the fingers 18*b* and 20*b* of the upper tier 18*a* and the intermediate tier 20*a* are designed to be resilient or flexible enough to permit a golf club to be easily inserted therein and yet stiff enough to securely hold the golf club during movement of the carrier. The bottom tier 22*a* may be an enclosed wire form which provides a restraining member for golf clubs which are attached to the upper and intermediate tiers. Thus when attaching a golf club into the carrier 10 one may insert the handle portion into the enclosed loop of the lower tier 22*a* and then, using the lower tier 22*a* as a pivot or fulcrum point, proceed to push the shank of the club into the attaching fingers of the intermediate tier 20*a* and the upper tier 18*a*. By using the lower tier 22*a*** as a fulcrum the clubs may be easily attached to the carrier.

The carrier 10 of this invention is highly portable and of a simplified design which will keep manufacturing costs within a range which will be attractive to a large segment of our population. The pointed tip 14 permits upright storage of the carrier, for example, when the carrier is used for golfing, by simply inserting tip 14 into the ground. Tip 14 can also combine with either the upper stabilizing legs 44 or lower stabilizing legs 46 to provide three point support for upright storage in a locker room, closet or any other location where only the pointed end 14 would be inadequate.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A carrying device for golf clubs having a skeletonized construction, the improvement comprising:

an elongated frame member having a handle portion and having an end portion for upright positioning of the carrying device;

a plurality of club supporting tiers including a bottom tier and at least two upper tier means having openings adapted to receive golf clubs for portable transport;

said supporting tiers being in vertical alignment and attached at an edge to the elongated frame member;

a pair of spaced framing rod means being positioned opposite the elongated frame member and extending parallel thereto and interconnecting the bottom tier with each upper tier means;

a ball carrier for golf balls including a top plate with an enlarged top opening for insertion and removal of balls, and said ball carrier also including a bottom plate with an opening for receiving and nesting a ball during storage;

said top and bottom plates of the ball carrier being mounted adjacent said pair of framing rod means, and a reinforcing rod also extending from the bottom plate to the top plate and cooperating with said framing rod means to form an elongated triangular ball holding enclosure for storing a plurality of golf balls; and, fixed stabilizing leg means extending outwardly and generally horizontally from said carrying device and being adapted to combine with the elongated frame member for bracing the article carrying device in an inclined position, each upper tier means having a thicker portion surrounding said openings and extending around the periphery thereof, and, a thinner web section interconnecting the thicker portions; and each upper tier means being constructed from an injection molded material.

* * * * *